US009673579B2

(12) United States Patent
Gassner

(10) Patent No.: US 9,673,579 B2
(45) Date of Patent: Jun. 6, 2017

(54) PORTABLE USB CHARGING HAND CONTROLLER WITH TWIST-ON COVER

(71) Applicant: LIMOSS (SHENZHEN) CO., LTD, Shenzhen (CN)

(72) Inventor: Christian Gassner, Shenzhen (CN)

( * ) Notice: Subject to any disclaimer, the term of this patent is extended or adjusted under 35 U.S.C. 154(b) by 21 days.

(21) Appl. No.: 14/804,966

(22) Filed: Jul. 21, 2015

(65) Prior Publication Data

US 2016/0329666 A1 Nov. 10, 2016

(30) Foreign Application Priority Data

May 5, 2015 (CN) ..... 2015 2 02828810 U

(51) Int. Cl.

| | |
|---|---|
| ***H01H 1/58*** | (2006.01) |
| ***H01R 24/60*** | (2011.01) |
| ***H01H 13/14*** | (2006.01) |
| ***H01H 13/02*** | (2006.01) |
| ***H01R 13/70*** | (2006.01) |
| ***H01R 13/717*** | (2006.01) |
| ***H01R 24/62*** | (2011.01) |
| *H01R 107/00* | (2006.01) |

(52) U.S. Cl.

CPC ..... *H01R 24/60* (2013.01); *H01H 13/023* (2013.01); *H01H 13/14* (2013.01); *H01R 13/70* (2013.01); *H01R 13/717* (2013.01); *H01R 24/62* (2013.01); *H01H 2219/036* (2013.01); *H01R 2107/00* (2013.01); *H01R 2201/06* (2013.01)

(58) Field of Classification Search

CPC .... H05K 5/0256; H05K 5/0278; G06F 1/181; H02G 3/14; H02G 3/185; G06K 19/0772; G06K 19/07732

USPC ..... 200/51 R; 439/535, 538; 248/906; 174/542, 50, 520, 535

See application file for complete search history.

(56) References Cited

U.S. PATENT DOCUMENTS

| | | | | |
|---|---|---|---|---|
| 7,361,032 | B2 * | 4/2008 | Loftus | H01R 13/4538 439/131 |
| 8,308,494 | B1 * | 11/2012 | Zhao | H01R 13/60 439/131 |
| 2011/0261511 | A1 * | 10/2011 | Alderson | H01H 13/86 361/679.01 |

* cited by examiner

*Primary Examiner* — Vanessa Girardi

(74) *Attorney, Agent, or Firm* — James M. Smedley LLC; James Michael Smedley, Esq.

(57) ABSTRACT

The present invention discloses a portable remote controller, which comprises a remote controller body and a cover covering the remote controller body; hooks are arranged on the back of the cover, and slots to fit the hooks are arranged at corresponding positions in an upper rim of the remoter body; press buttons are arranged in a front of the cover. The portable remote controller with added USB charging function can not only fulfill the regular remoter control functions for intelligent living, but its USB interface is also able to charge almost all intelligent devices in the market, including almost all intelligent phones and tablets; thus when people are using intelligent devices in daily life, they will no longer worry about low batteries; also the cover is easy to remove and install, convenient to users.

5 Claims, 8 Drawing Sheets

PORTABLE USB CHARGING HAND CONTROLLER WITH TWIST-ON COVER

FIELD OF THE INVENTION

The present invention relates to the field of remote control device technology, and more particularly, to a portable remote controller with a USB interface.

CROSS-REFERENCES TO RELATED APPLICATIONS

This application claims the priority of Chinese patent application no. 2015202828810, filed on May 5, 2015, the entire contents of all of which are incorporated herein by reference.

BACKGROUND

In the era of mobile internet, the ways of people's leisure and work are undergoing tremendous changes, people may use intelligent devices (such as intelligent phones, tablets, intelligent watches and more) on various occasions for entertainment or work, however, the problem of battery runtime of these devices may bring troubles to users, which means these devices may need to be charged any time. A traditional product has a single remote function or charging function only, which has been unable to adapt to the people's life requirements in the internet era.

Therefore, the prior art needs to be improved and developed.

BRIEF SUMMARY OF THE DISCLOSURE

The technical problems to be solved in the present invention is, aiming at the defects of the prior art, to provide a portable wired remote controller with a USB interface, in order to solve the problem in the prior art, that the existing remote controller products have no charging functions.

The technical solution of the present invention to solve the technical problems is as follows:

A portable remote controller that comprises a remote controller body and a cover; the cover twists onto the remote controller body, while adapting to different sizes of the remote controller body; a hook is arranged on a back of the cover, and a slot to fit the hook is arranged at a corresponding position in an upper rim of the remote controller body; a press button is arranged in a front of the cover.

The portable remote controller wherein the hook contains a vertical section and a transverse section; wherein the vertical section is perpendicular to the back of the cover, and wherein the transverse section is perpendicular to the vertical section, and both sections together form an L-shaped hook 210 as shown in FIG. 2; wherein the slot contains a first hole and a second hole; wherein the first hole is configured to fit the transverse section, the second hole connects to the first hole thus both holes together form the slot 120 as shown in FIG. 1, and the second hole is configured to fit the vertical section.

The portable remote controller wherein a shape of the remote controller body is round, elliptical or polygonal.

The portable remote controller wherein a backlight structure is arranged on the press button.

The portable remote controller wherein the press button is round, crescent or polygonal. The portable remote controller, wherein the number of the press buttons is at least two. The portable remote controller wherein a USB interface is configured in the remote controller body, and the USB interface is configured to connect to a charging circuit.

The portable remote controller wherein a USB interface slot is configured in the cover.

Benefits: the portable remote controller with USB charging function can not only satisfy the regular remote control functions for intelligent living, but also its USB interface is able to supply power to charge almost all intelligent devices in the market, including almost all intelligent phones and tablets, thus when people are using intelligent devices in their daily lives, they will no longer worry about low batteries; also the cover is easy to remove and install, convenient to users.

DETAILED DESCRIPTION

In order to make the purpose, technical solution and the advantages of the present invention clearer and more explicit, further detailed descriptions of the present invention are stated here, referencing the attached drawings and some embodiments of the present invention. It should be understood that the detailed embodiments of the invention described here are used to explain the present invention only, instead of limiting the present invention.

Figure 1:
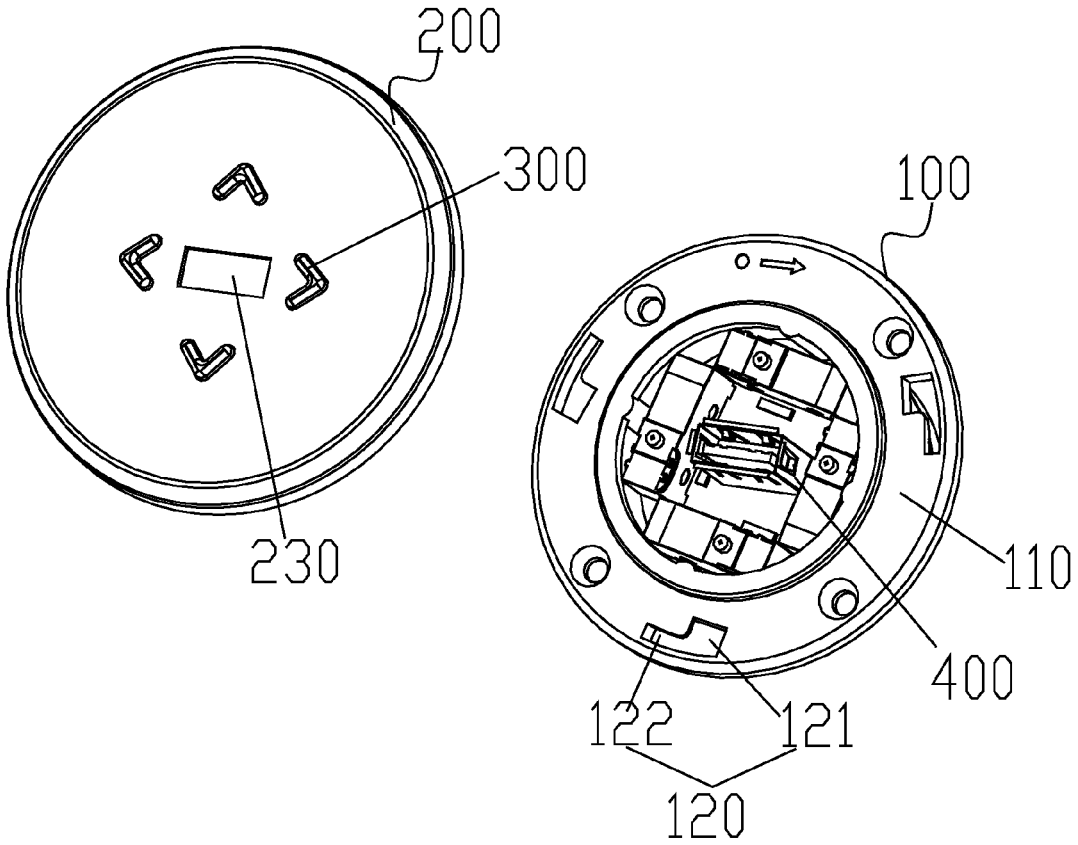
FIG. 1 illustrates an explored view of a portable USB hand controller described in the present invention.

Referring to FIG. 1, a portable remote controller provided in the present invention includes a remote controller body 100, and a cover 200; the cover adapting to the sizes of the remote controller body 100 and to twist-onto the remote controller body 100. The connection between the remote controller body 100 and the cover 200 is a twist-on connection, i.e., it is possible to assemble the cover 200 onto the remote controller body 100 by turning the cover 200, also, it is convenient to disassemble the cover 200 fast, which shows that adopting a twist-on connection method can not only lower the cost, but also make it convenient to assemble and disassemble. However, traditionally, most snap-on connections are adopting a plurality of pressed snaps for connections, which is easy for assembling, however, during disassembling processes, it is easy to cause damage to the remote controller, such as scratching the remote controller surfaces, damaging some parts inside the hand controller due to vibrations caused by excessive force, or causing individual snap damage.

In specific embodiments of the present invention, a hook 210 is disposed on a back of the cover 200, and a corresponding slot 120 is arranged in the remote controller body 100, that is configured to connect to the hook 210 upon twisting the cover 200, wherein the remote controller body 100 adapts to the cover 200, that is, the slot 120 that accommodates the hook 210 is configured in the corresponding position on the upper rim 110 of the remote controller body 100. The slot 120 arranged on the upper rim 110 of the periphery of the remote controller body 100 may accommodate the hook 210, and achieve a fixed connection to the hook 210 after connecting the slot 120 to the hooks 210 by twisting in one direction, that is, fixing the cover 200 in place and preventing it to get loose in the other direction. One or more hooks 210 are arranged on the back of the cover 200, and the same number of slots 120 as that of hooks 210 is arranged in the corresponding positions in the remote controller body 100. In a specific embodiment, the number of hooks 210 is set to be three, and the corresponding number of the slots 120 is also set to be three, and the hooks 210 are distributed unevenly, and are adapted with foolproof settings, in order to avoid user operations that are in error.

Figure 2:
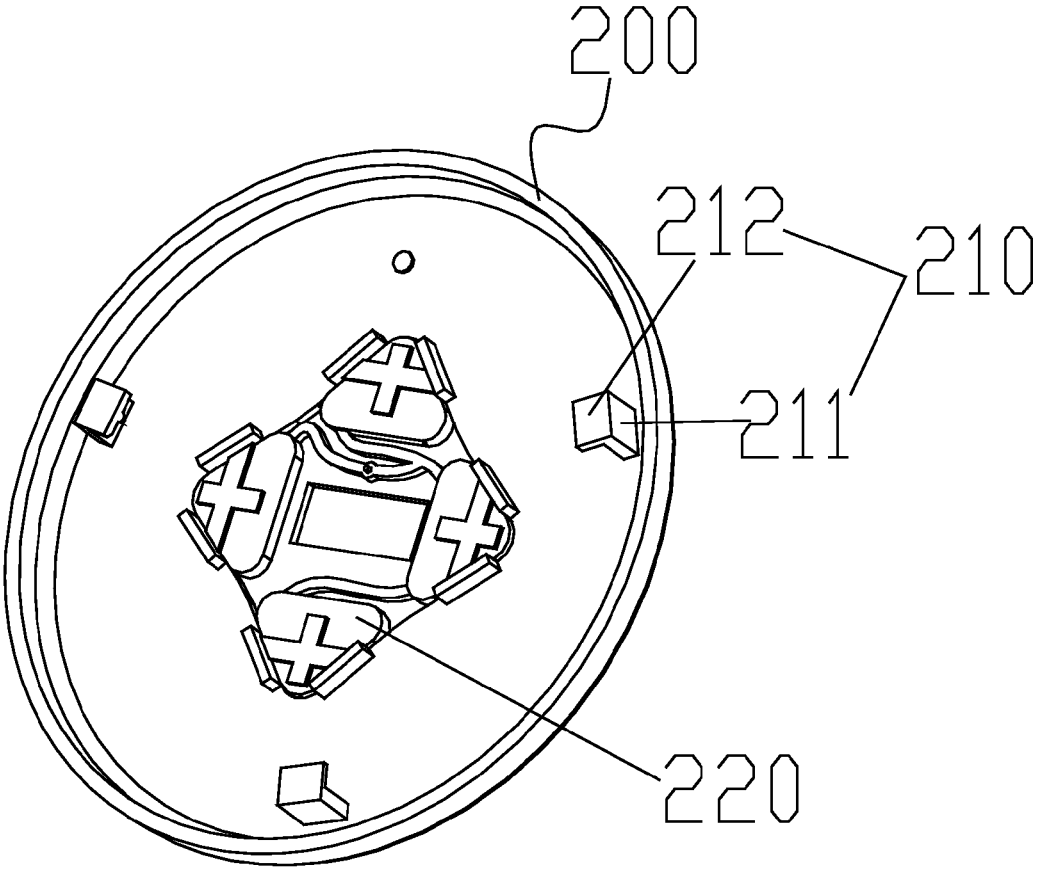
FIG. 2 illustrates a schematic diagram of a back cover of the portable remote controller described in the present invention.

Furthermore, referring to FIG. 1 and FIG. 2 together, every hook 210 arranged on the back of the cover 200 includes a vertical section 211 and a transverse section 212; the vertical section 211 is perpendicular to the back of the cover 200, and the transverse section 212 is perpendicular to the vertical section 211. The vertical section 211 is arranged to locate the turning angles of the cover 200, while the transverse section 212 is arranged to fix the cover 200. Accordingly, each of the slots 120 includes a first hole 121 and a second hole 122; the first hole 121 is configured to fit the transverse section 212, and the second hole 122 connects to the first hole 121 and is configured to fit the vertical section 211.

Figure 3:
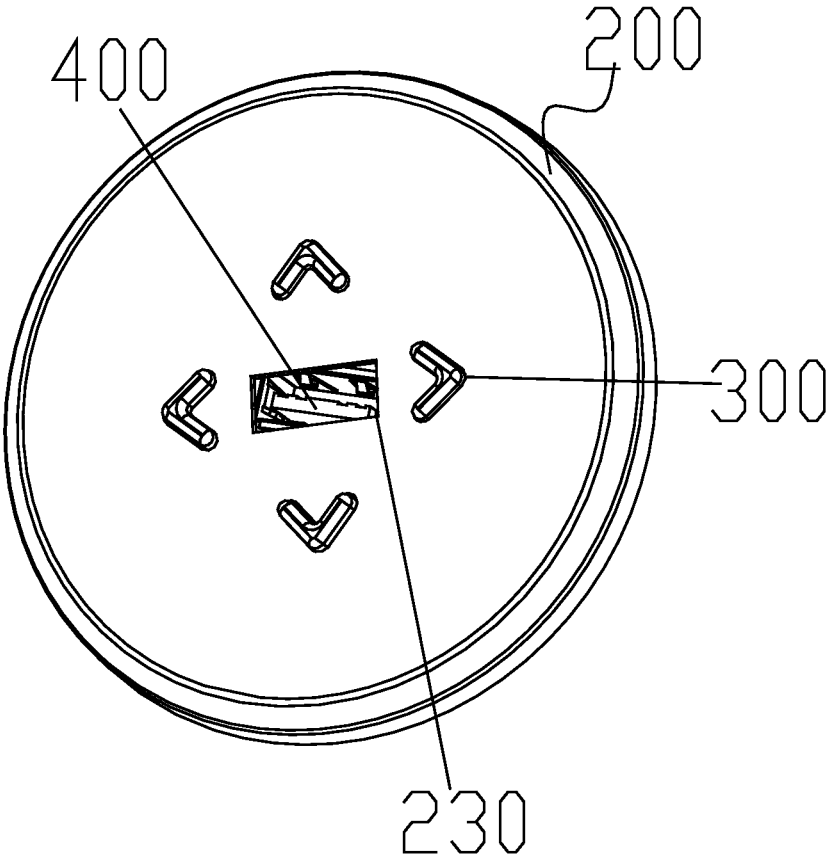
FIG. 3 illustrates a schematic diagram of the cover of the portable USB hand controller before twisting the cover onto the remote controller body in the first angle of view described in the present invention.
Figure 4:
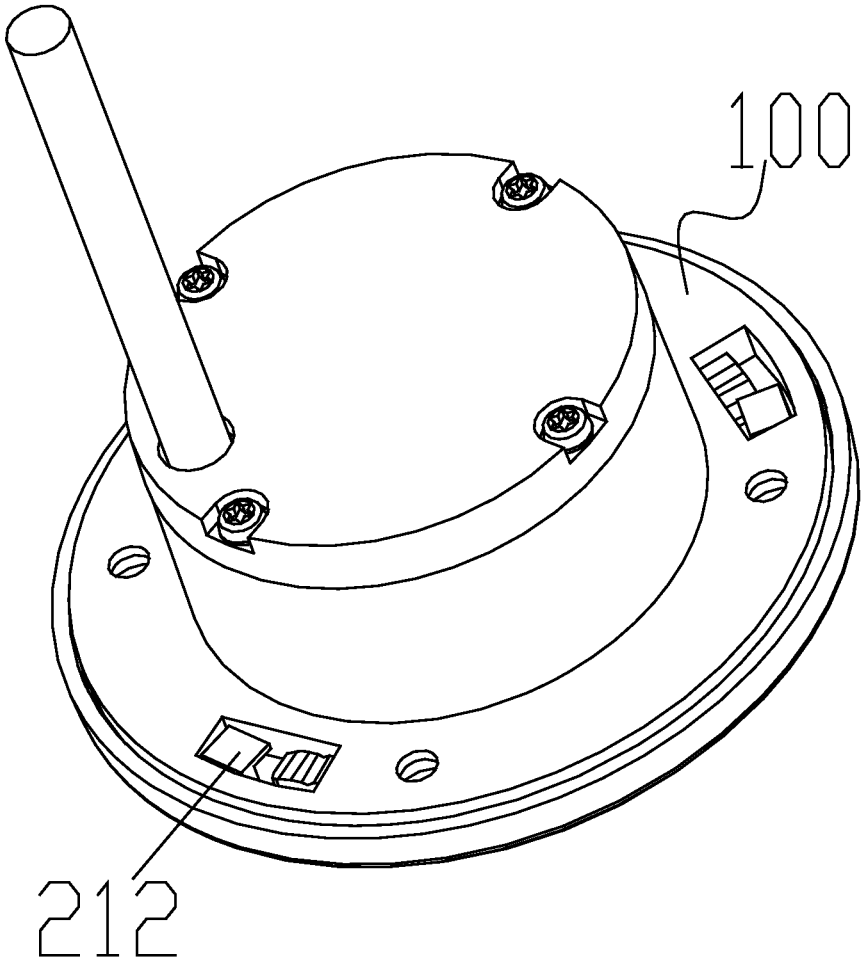
FIG. 4 illustrates a schematic diagram of the cover of the portable USB hand controller before twisting the cover onto the remote controller body in the second angle of view described in the present invention.
Figure 5:
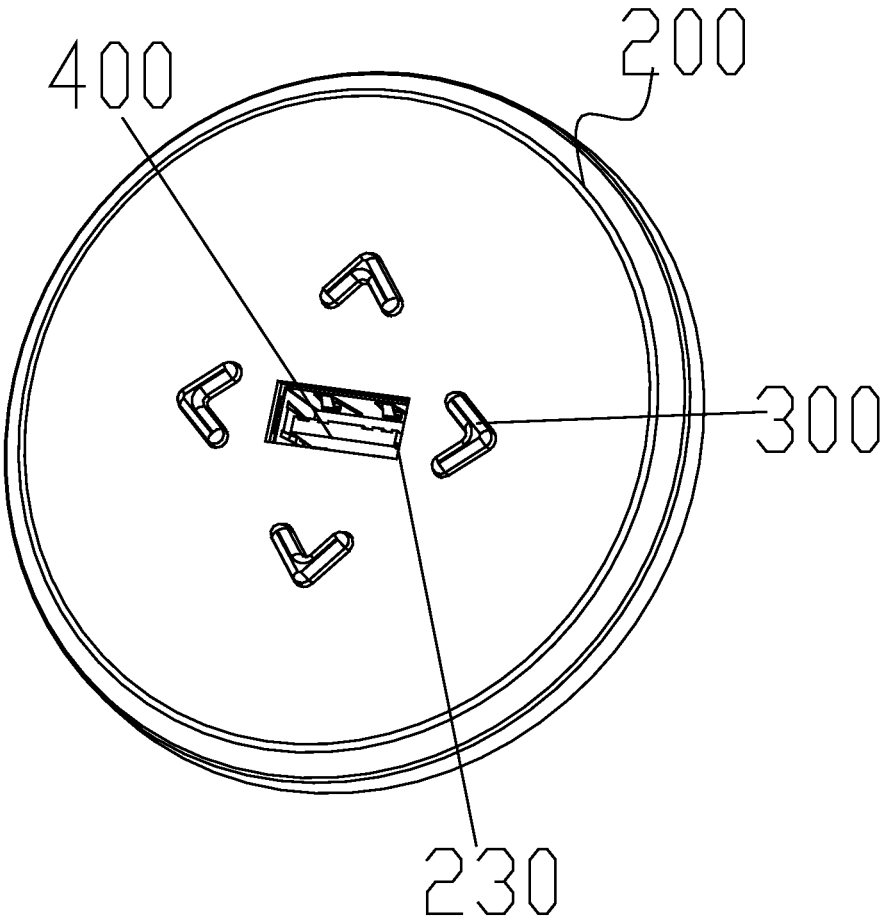
FIG. 5 illustrates a schematic diagram of the cover of the portable remote controller after twisting the cover onto the remote controller body in the first angle of view described in the present invention.
Figure 6:
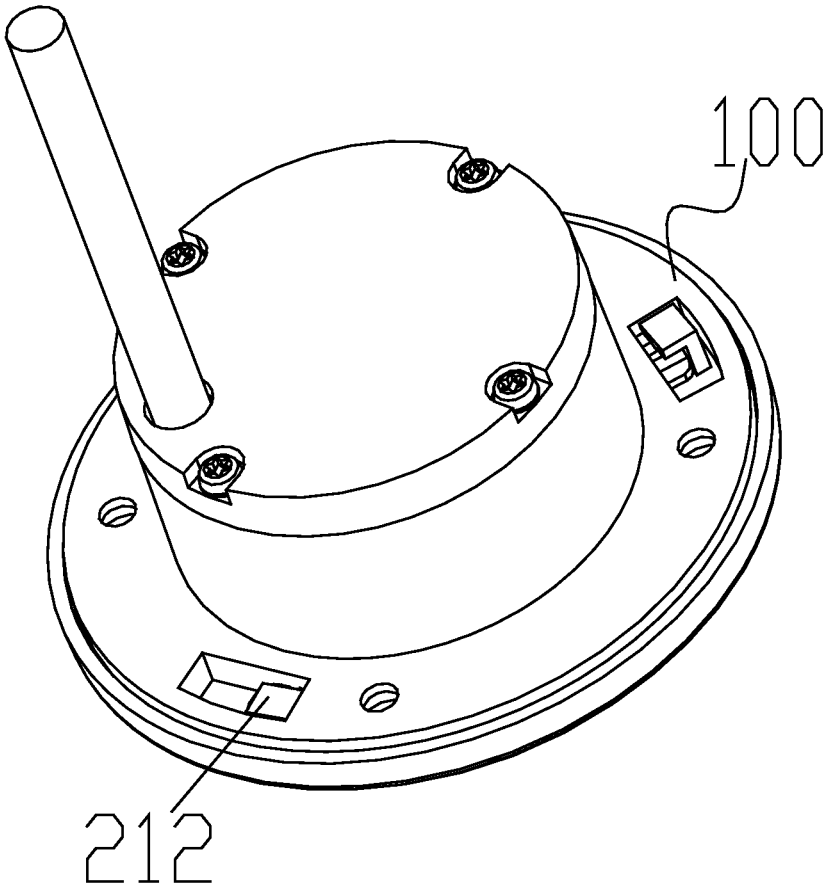
FIG. 6 illustrates a schematic diagram of the cover of the portable remote controller after twisting the cover onto the remote controller body in the second angle of view described in the present invention.

Referring to FIG. 3 up to FIG. 6 together, when assembling the cover 200 and the remote controller body 100, the only thing needed is to insert the hook 210 that is disposed on the cover 200 into the corresponding first hole 121 in the slot 120, and then to rotate the cover 200 in clockwise direction, making the hook 210 insert into the second hole 122 in the slot 120; now the transverse section 212 of the hook 210 is positioned at the second hole 122 in the slot 120, and that finishes the twist-on connection between the cover 200 and remote controller body 100. In an embodiment of the present invention, three hooks 210 and three slots 120 are arranged evenly on the cover 200 and correspondingly on the upper rim 110 of the remote controller body 100. Of course, more hooks 210 and slots 120 connecting the cover 200 to the shell 110 may be chosen.

Figure 7:
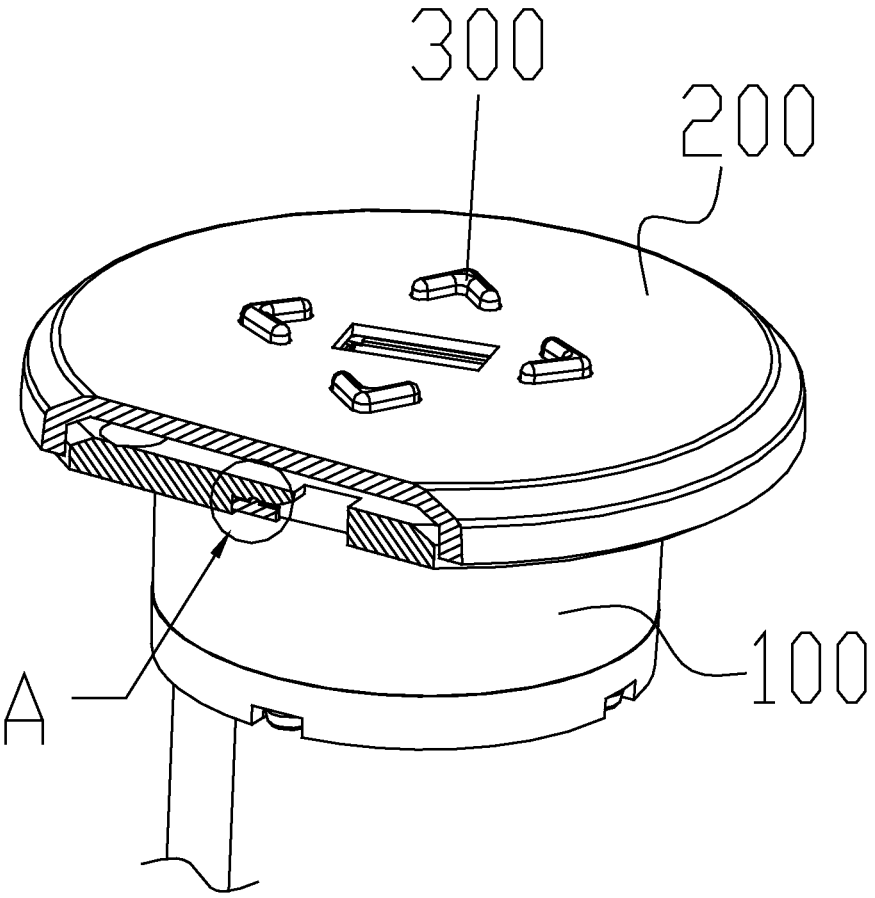
FIG. 7 illustrates a cutaway perspective view of local section of the portable remote controller described in the present invention.
Figure 8:
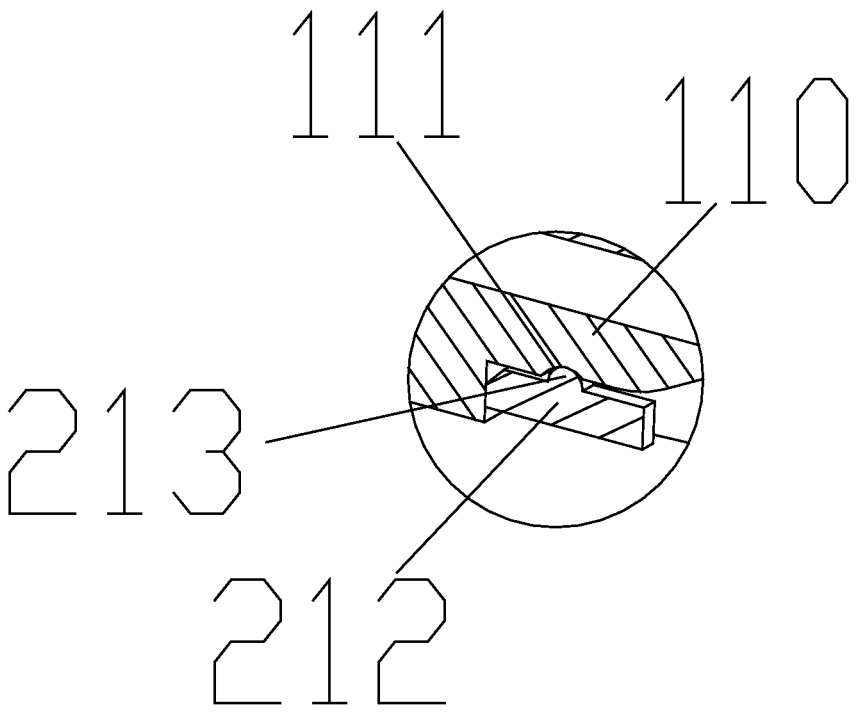
FIG. 8 illustrates a schematic diagram of an enlarged area A in FIG. 7.

Furthermore, as shown in FIG. 7 and FIG. 8, a projection 213 is arranged on the transverse section 212 of the hook 210, the projection 213 is semi-circular shaped; a groove 111 is arranged on the upper rim 110, that corresponds to the projection 213, and the groove 111 adapts to the projection 213 after the cover 200 twists onto the remote controller body 100, that is, the projection 213 is fixed in the groove 111, and that twist-on connects the cover 200 to the remote controller body 100, while also fixing the cover 200, preventing the cover 200 from easily getting loose in the other direction.

In an embodiment of the present invention, the upper rim 110 of the remote controller body 100 has a round, elliptical or polygonal shape. That is, the upper rim 110 may have a plurality of shapes, including round shapes, elliptical shapes or polygonal shapes. Different shapes adopted by the upper rim 110 may provide different choices to customers, more options to customers, and provide a plurality of appearances for the products, that makes the products easy to sell.

Furthermore, as shown in FIG. 1, in the portable remote controller provided in the present invention, a press button 300 is arranged in a front face of the cover 200, and operating the press button 300 may control the corresponding devices or appliances. The number of the press button 300 is at least two, and in one preferred embodiment of the present invention, the number of the press button 300 is four.

Furthermore, as shown in FIG. 2, a backlight structure 220 is arranged on the press button 300, and when the press button 300 is pressed, the backlight structure 220 will emit light in different colors, so that the press button 300 is no longer monotonous. The backlight structure 220 may emit light in blue, red, green, yellow or other colors. Of course, the colors emitted from the backlight structure 220 in the present invention are not limited to those listed above, and they may be customized by users.

The press button 300 may also be configured in different shapes. Specifically, the shape of the press button 300 may be circular, crescent or polygonal, and that increases the beauty of the product's appearance.

Furthermore, as shown in FIG. 1, a USB interface 400 is arranged in the remote controller body 100, which connects to a charging circuit. That is, a charging function through a USB interface is added to the remote controller, as provided in the present invention, which can not only satisfy the regular remote control functions for intelligent living, but its USB interface is also able to supply power to charge almost all intelligent devices in the market, including almost all intelligent phones and tablets.

Accordingly, as shown in FIG. 1, a USB interface slot 230 is configured to fit the USB interface 400 that is arranged in the cover 200. When in use, a USB cable may connect the device for charging by the USB interface 400 and to start charging. Thus when people are using intelligent devices in daily living, they will no longer worry about low batteries.

In summary, the present invention discloses a portable remote controller, which comprises a remote controller body and a cover that twists onto the remote controller body and adapts to the size of the remote controller body; hooks are arranged on the back of the cover, and slots to fit the hooks are arranged at the corresponding positions in an upper rim of the remote controller body; press buttons are arranged in a front of the cover. The portable remote controller provided in the present invention adds a USB charging function, and can not only satisfy the regular remote controller functions for intelligent living, but its USB interface is also able to supply power to charge almost all intelligent devices in the market, including almost all intelligent phones and tablets; thus when people are using intelligent devices in daily life, they will no longer worry about low batteries; also the cover is easy to remove and install, convenient to users.

It should be understood that the application of the present invention is not limited to the above examples listed. It will be possible for a person skilled in the art to make modifications or replacements according to the above descriptions, which shall all fall within the scope of protection in the appended claims of the present invention.

The invention claimed is:

1. A portable remote controller, comprising:

a remote controller body and a USB interface disposed inside of said remote controller body and an upper rim disposed on the periphery of said remote controller body; and a cover configured to rotatably connect to said upper rim, said cover comprising a centrally disposed USB interface slot that aligns with said USB interface when said cover is rotatably connected to said remote controller body, and a plurality of press buttons disposed around said USB interface slot and configured to remotely control one or more electronic devices.

2. The portable remote controller according to claim 1, wherein the back of said cover comprises a plurality of L-shaped hooks, wherein said L-shaped hooks are configured to be inserted into corresponding slots in said upper rim of said remote controller body, and contact a surface of said upper rim as said cover is rotated with said L-shaped hooks in said slots, forming a tight fit between said cover and said upper rim.

3. The portable remote controller according to claim 1, wherein a shape of the remote controller body is selected from the group consisting of: round, elliptical, and polygonal.

4. The portable remote controller according to claim 1, wherein said cover includes a backlight for each of said press buttons, wherein said backlight emits different colors of light whenever one of said press buttons is pressed.

5. The portable remote controller according to claim 1, wherein the USB interface is connected to a charging circuit.

* * * * *